US007192109B2

(12) United States Patent
Wang

(10) Patent No.: US 7,192,109 B2
(45) Date of Patent: Mar. 20, 2007

(54) ENVIRONMENTAL PROTECTION INK CARTRIDGE CONTROL

(76) Inventor: Alex Kuo-Shen Wang, 8658 Panuco Way, Las Vegas, NV (US) 98147

( * ) Notice: Subject to any disclaimer, the term of this patent is extended or adjusted under 35 U.S.C. 154(b) by 269 days.

(21) Appl. No.: 10/890,954

(22) Filed: Jul. 14, 2004

(65) Prior Publication Data

US 2006/0012619 A1 Jan. 19, 2006

(51) Int. Cl.
*B41J 2/195* (2006.01)

(52) U.S. Cl. ..... 347/7; 347/86

(58) Field of Classification Search ..... 347/7
See application file for complete search history.

(56) References Cited

U.S. PATENT DOCUMENTS 5,670,995 A * 9/1997 Kupcho et al. ..... 347/5
6,616,255 B2 * 9/2003 Murakami et al. ..... 347/7
6,995,861 B1 * 2/2006 Saruta et al. ..... 358/1.9
7,029,083 B2 * 4/2006 Merz et al. ..... 347/7
2005/0172118 A1 * 8/2005 Nasu ..... 713/156

* cited by examiner

*Primary Examiner*—Manish S. Shah
*Assistant Examiner*—Brian J. Goldberg
(74) *Attorney, Agent, or Firm*—Pro-Techtor Int'l Services

(57) ABSTRACT

The present invention provides an environmental protection ink cartridge control chip, wherein the control chip is structured to embody a CPU control circuit, a data bus and a plurality of memory chips. The control chip is installed on an ink cartridge, and transmits signals to a printer by means of the data bus. The memory chips separately provide functionality to monitor ink amount within the original ink cartridge, set ink amount return point of the ink cartridge and restore ink amount value after the ink cartridge has reached the return point. Hence, the control chip can provide for repeated usage of the ink cartridge until the control chip malfunctions, thereby achieving effectiveness of environmental protection.

2 Claims, 3 Drawing Sheets

ENVIRONMENTAL PROTECTION INK CARTRIDGE CONTROL

BACKGROUND OF THE INVENTION (a) Field of the Invention

The present invention provides functionality for repeated usage of a printer ink cartridge, thereby averting environmental problems caused by mass discarding of ink cartridges after usage.

(b) Description of the Prior Art

Referring to FIG. 1, which shows an ink cartridge 100 of a general inkjet printer having a sponge 200 packed within the ink cartridge 100, and wherewith capillarity of the sponge 200 is utilized to supply a steady and even quantity of ink to a nozzle of the printer. However, because of inability of the ink cartridge 100 to be reused, the ink cartridge 100 must be disposed of after the ink within is depleted. Even though a user can reluctantly re-inject ink into the ink cartridge 100, repeated injecting of ink will slowly cause deterioration of the sponge 200, and thus influence print quality of the ink cartridge 100, resulting in inability to reuse. As a consequence the Ink cartridges 100 are disposed of in considerable quantities, bringing about serious problems in environmental protection recovery.

SUMMARY OF THE INVENTION

A primary objective of the present invention is to provide a control chip structured to embody a CPU control circuit, a data bus and a plurality of memory chips, wherewith the control chip can provide for repeated usage of the ink cartridge until the control chip malfunctions. Hence, apart from maintaining printing quality and functionality of the ink cartridge, moreover, the control chip of the present invention achieves effectiveness of environmental protection.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
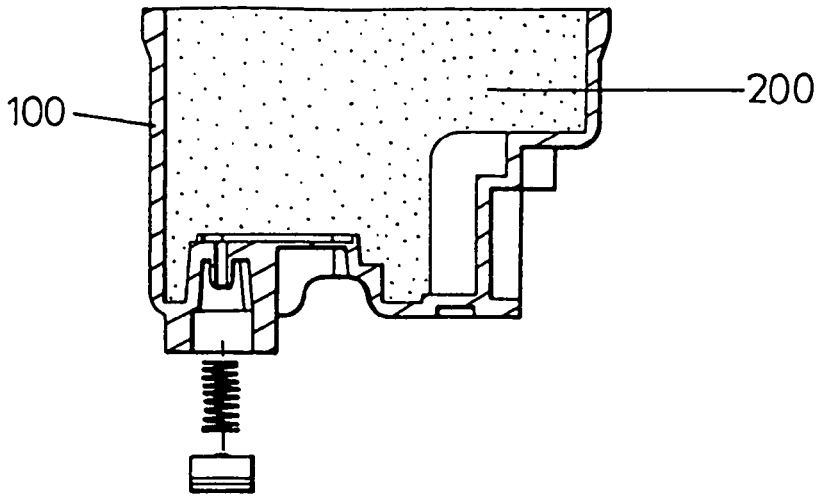
FIG.1 (PRIOR ART)
FIG. 1 shows a cross-sectional view of a conventional ink cartridge.
Figure 2:
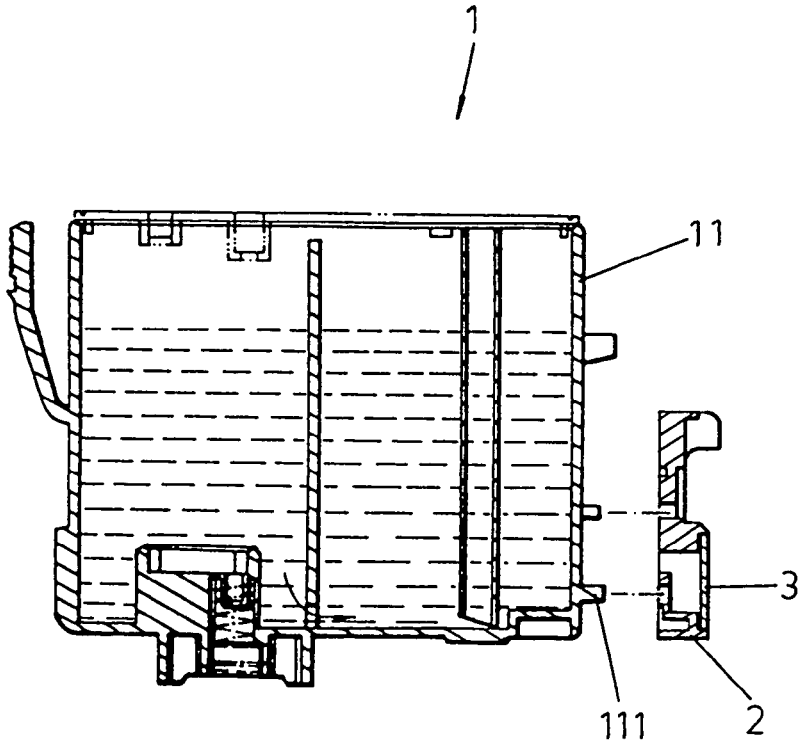
FIG. 2 shows a cross-sectional view according to the present invention.

Referring to FIG. 2, which shows a chip socket 2 being removeably plugged onto a clip retainer 111 on one side of a plastic casing 11 of an ink configured atop the chip socket 2.

Figure 3:
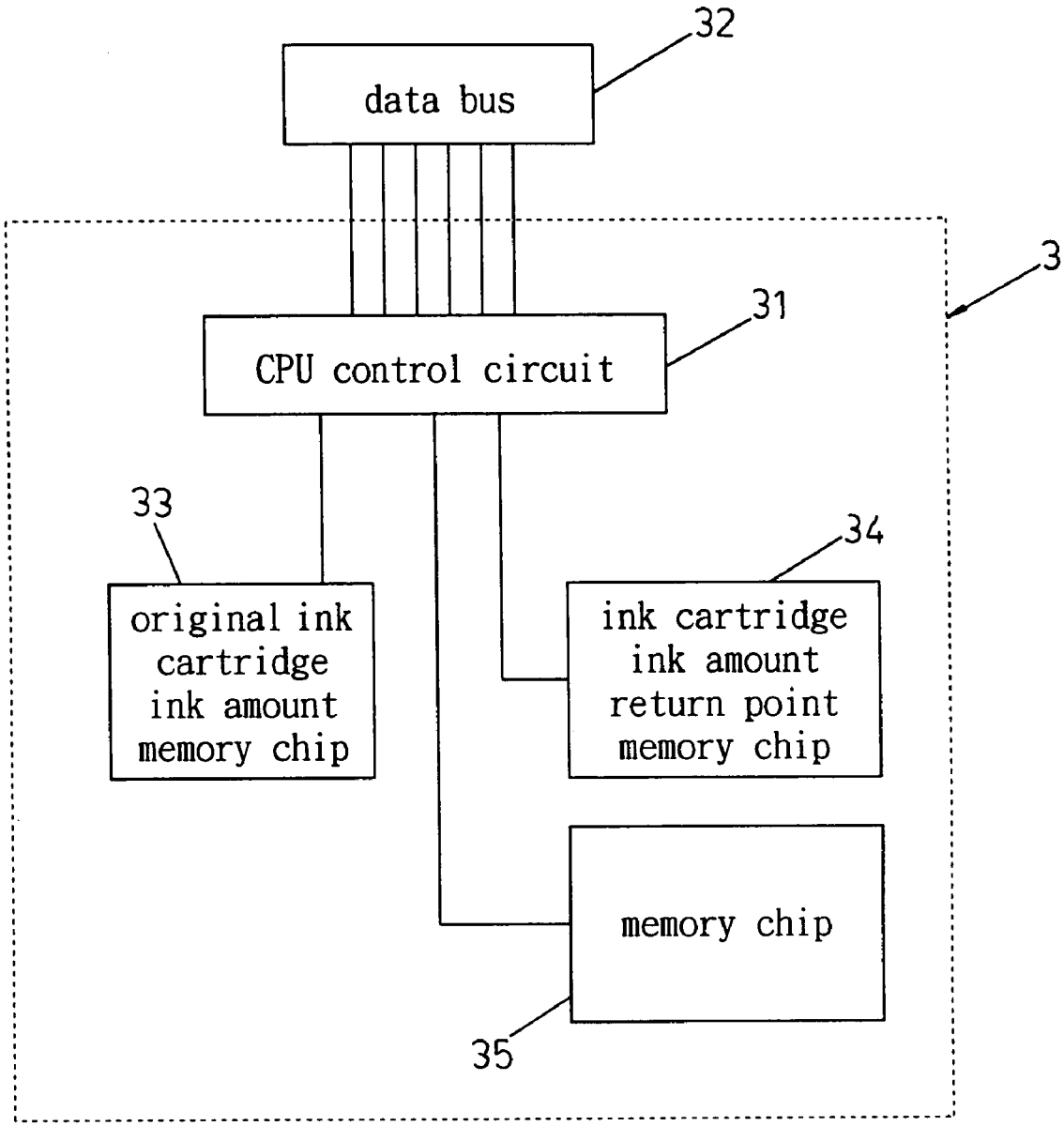
FIG. 3 shows a block diagram according to the present invention.

Referring to FIG. 3, the control chip 3 is structured to comprise a CPU control circuit 31, a data bus 32, an original ink cartridge ink amount memory chip 33, an ink cartridge ink amount return point memory chip 34, and a memory chip 35 that resets the ink amount restore value after ink amount of the ink cartridge 1 has reached a return point and has been refilled. One end of the data bus 32 is connected to the CPU control circuit 31, and another end of the data bus 32 is adapted for connection to a printer, thereby realizing signal transmission between the printer and the control chip 3. Furthermore, the three memory chips 33, 34 and 35 are separately connected to the CPU control circuit 31, wherein the original ink cartridge ink amount memory chip 33 is provided with a memory capacity of over 256K.

Figure 4:
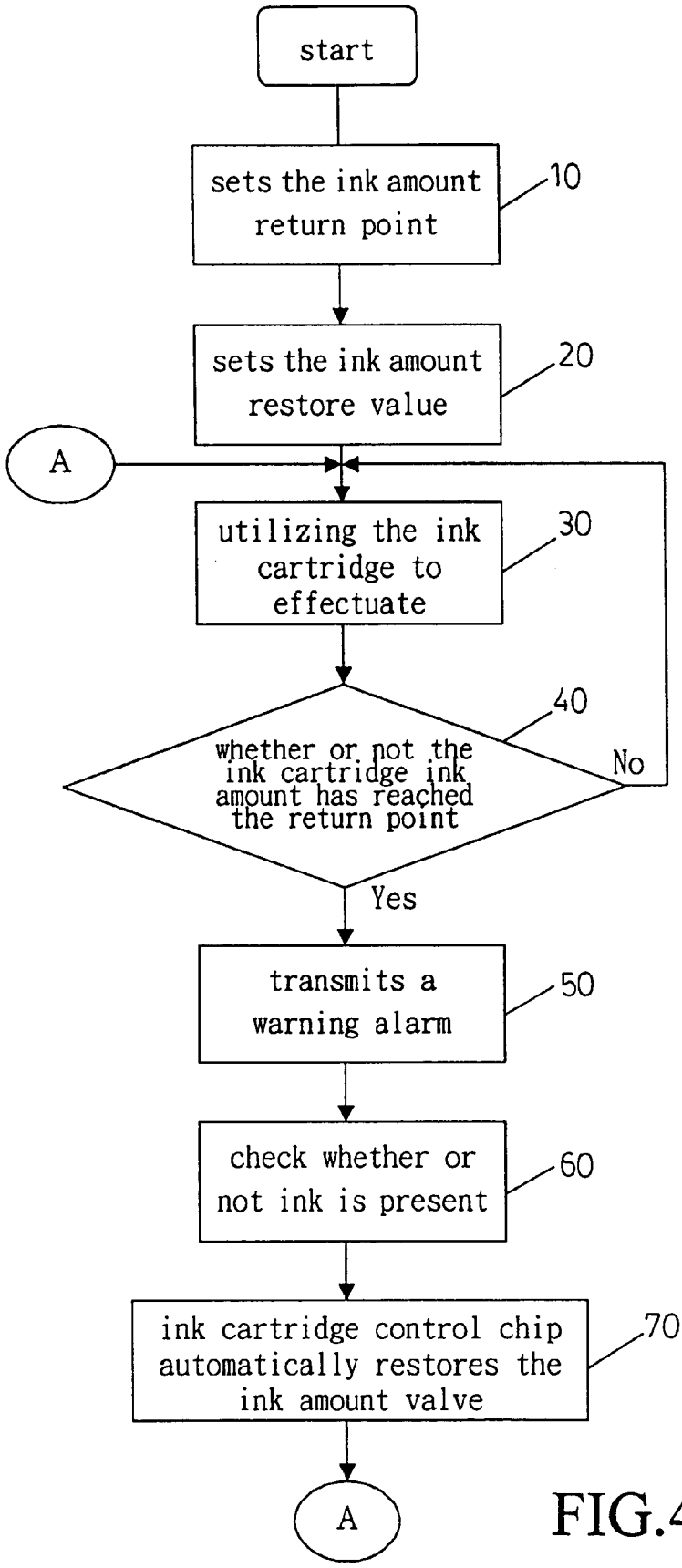
FIG. 4 shows an operating flow chart according to the present invention.

Referring to FIG. 4, in step 10 and prior to using the printer, the control chip 3 of the present invention first sets the ink amount return point, and in step 20 sets the ink amount restore value. Thereafter, printing commences in step 30, utilizing the ink cartridge to effectuate such. Whereupon, in step 40, the control chip determines whether or not the ink cartridge ink amount has reached the return point, if not, then operating procedure returns to step 30 and continues to utilize the ink cartridge for printing out. Whereas, if the ink cartridge ink amount has reached the return point, then the operating procedure proceeds to step 50 and transmits a warning alarm, whereafter, in step 60, observation is made on the ink cartridge 1 to check whether or not ink is present. Observation is realized through two methods: pressing a withdraw key on the ink cartridge 1 or switching off the printer, which thereby effectuates withdrawing of the ink cartridge 1, thereafter, the naked eye is used to check whether or not ink is present within the ink cartridge, and after manually refilling the ink cartridge 1 with ink and replacing, the ink cartridge control chip 3 automatically resets the ink amount restore value in step 70, and the operating procedure again returns to step 30 to continue using the ink cartridge for printing out.

Description of the aforementioned flow chart thus discloses how the ink cartridge 1 is provided with functionality for repeated usage until the control chip 3 malfunctions, thereby effectuating functionality of recycling, and moreover, achieves effectiveness of environmental protection. The present invention is characterized in that:

1. Maintains original functionality of calculating ink amount.

2. Achieves functionality to set a warning alarm for ink amount return point, therewith signifying necessity to replenish ink amount or to switch on and re-calculate.

3. Restores ink amount value, thereby enabling continuous usage of the ink cartridge.

4. The control chip 3 retains record of the ink amount when switching on or switching off the printer, and thus will not lose record of the ink amount following switching on or switching off, which would otherwise result in absence of ink within the ink cartridge, and thereby cause damage to a nozzle of the printer.

In conclusion, the present invention realizes functionality for repeated usage of the ink cartridge, thereby averting pollution of global environment.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An environmental protection ink cartridge with a control chip, comprising:

an ink cartridge having a plastic casing with a refillable ink reservoir, and a clip retainer on an exterior side thereof; and a chip socket, fittingly adapted to removeably plug into said clip retainer, having a CPU control circuit;

a data bus, one end of which is connected to the CPU control circuit, and another end of which is adapted for connection to a printer;

a plurality of rewriteable memory chips, consisting of an ink amount memory chip, a return point memory chip, and a restore value memory chip, which are each separately connected to the CPU control circuit, and separately provide functionality to monitor an ink amount within the ink cartridge, set an ink amount return point of the ink cartridge and reset an ink amount restore value after the ink cartridge has reached the return point and has been refilled;

wherein the control chip is first configured on a chip socket, the chip socket being further plugged onto the ink cartridge.

2. The environmental protection ink cartridge with a control with a chip according to claim 1, wherein the ink amount memory chip is provided with a memory capacity of over 256K.

* * * * *